US008809243B2

(12) United States Patent
Schmid-Amelunxen et al.

(10) Patent No.: US 8,809,243 B2
(45) Date of Patent: Aug. 19, 2014

(54) WATER-BASED LUBRICANTS

(75) Inventors: Martin Schmid-Amelunxen, Roehrmoos/Arzbach (DE); Martin Schweigkofler, Friedberg (DE); Thomas Kilthau, Geretsried (DE); Jochen Muehlemeier, Dachau (DE)

(73) Assignee: Klüber Lubrication München KG, München (DE)

( * ) Notice: Subject to any disclaimer, the term of this patent is extended or adjusted under 35 U.S.C. 154(b) by 0 days.

(21) Appl. No.: 13/391,351

(22) PCT Filed: Aug. 23, 2010

(86) PCT No.: PCT/EP2010/005157

§ 371 (c)(1),
(2), (4) Date: Feb. 20, 2012

(87) PCT Pub. No.: WO2011/026576

PCT Pub. Date: Mar. 10, 2011

(65) Prior Publication Data

US 2012/0149616 A1 Jun. 14, 2012

(30) Foreign Application Priority Data

Sep. 1, 2009 (DE) ..... 10 2009 039 626

(51) Int. Cl.

| | |
|---|---|
| ***C10M 169/04*** | (2006.01) |
| ***C10M 173/00*** | (2006.01) |
| ***C08G 63/00*** | (2006.01) |
| ***C10M 105/34*** | (2006.01) |
| ***C10M 107/34*** | (2006.01) |
| ***C10M 173/02*** | (2006.01) |

(52) U.S. Cl.

CPC ..... *C10M 107/34* (2013.01); *C10M 2207/1285* (2013.01); *C10N 2250/00* (2013.01); *C10N 2250/10* (2013.01); *C10M 2209/084* (2013.01); *C10N 2250/02* (2013.01); *C10M 2207/122* (2013.01); *C10M 2207/127* (2013.01); *C10N 2240/02* (2013.01); *C10N 2250/04* (2013.01); *C10M 173/02* (2013.01); *C10M 2201/062* (2013.01); *C10N 2240/04* (2013.01); *C10N 2230/06* (2013.01); *C10N 2220/10* (2013.01)

USPC ..... 508/161; 508/528; 508/494; 508/530; 508/463; 508/178

(58) Field of Classification Search

USPC ..... 508/161, 463

See application file for complete search history.

(56) References Cited

U.S. PATENT DOCUMENTS

| | | | | |
|---|---|---|---|---|
| 8,258,086 | B2 * | 9/2012 | Patel et al. | 508/113 |
| 2002/0095021 | A1 | 7/2002 | Pollmann et al. | |
| 2005/0256014 | A1 * | 11/2005 | Sherman et al. | 508/579 |
| 2006/0270569 | A1 * | 11/2006 | Athans | 508/491 |
| 2007/0027037 | A1 * | 2/2007 | Easter | 508/181 |
| 2011/0046027 | A1 * | 2/2011 | Zhamu et al. | 508/113 |

FOREIGN PATENT DOCUMENTS

| | | | |
|---|---|---|---|
| WO | 97/15643 | A1 | 5/1997 |
| WO | 2004/007651 | A1 | 1/2004 |
| WO | 2005/113640 | A1 | 12/2005 |
| WO | 2007/098523 | A2 | 9/2007 |

OTHER PUBLICATIONS

R. Van Voorst and F. Alam , Polyglycols as Base Fluids for Environmentally-Friendly Lubricants, Journal of Synthetic Lubrication, Leaf Coppin Publishing Ltd., Deal,Kent, GB, BD. 16, NR. 4, Jan. 1, 2000; 16-4, pp. 313-322, ISSN 0265-6582, XP007909273.

* cited by examiner

*Primary Examiner* — Vishal Vasisth

(74) *Attorney, Agent, or Firm* — Roberts Mlotkowski Safran & Cole, P.C.; David S. Safran

(57) ABSTRACT

Water-based lubricants for the lubrication of frictional partners in drive elements, as well as their use. In particular, a water-based lubricant that contains 5 to 80% by weight of water-soluble polyalkylene glycol that is selected from the group that is composed of statistically distributed polyoxyethylene units and/or polyoxypropylene units and/or other polyoxyalkylene components, a block polymer that that is composed of polyoxyethylene units and/or polyoxypropylene units and/or other polyoxyalkylene components, 0.5 to 20% by weight of foaming or non-foaming emulsifiers from the class of anionic, non-ionic, or cationic surfactants, water-soluble or water-emulsifiable carboxylic acid esters, 0.5 to 50% by weight of anti-icing additives, selected from the group that is composed of alkylene glycol, glycerol, salts or ionic liquids, 0.05 to 10% by weight of corrosion additives, 0.001 to 1% by weight of additives for preventing the formation of foam, and 0.05 to 5% by weight of friction-reducing agents and water added to make 100% by weight.

10 Claims, 1 Drawing Sheet

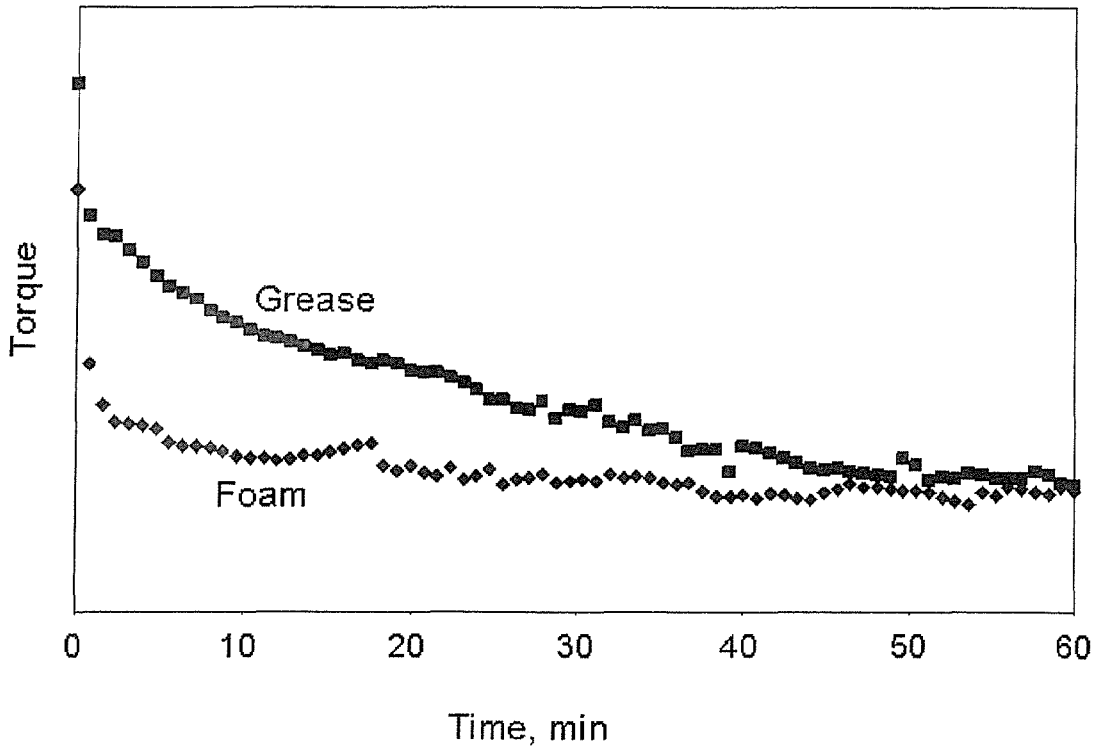
Torque
Grease
Foam
0
10
20
30
40
50
60
Time, min

WATER-BASED LUBRICANTS

This application is a 371 of PCT/EP2010/005157, filed Aug. 23, 2010.

BACKGROUND OF THE INVENTION

1. Field of the Invention

This invention relates to water-based lubricants. In particular, the invention relates to the use of water-based lubricants for the lubrication of frictional partners in drive elements, as well as their use.

2. Description of Related Art

The development of new lubricants must go along with the general further development of technology, which imposes new and more stringent requirements on the lubricant compositions, this in particular also with respect to environmental protection and carbon dioxide emissions. The known lubricants based on mineral oil or synthetic oil no longer measure up to these requirements.

Lubricants are used in particular in drive elements, such as, e.g., chains, gears, roller bearings, and plain bearings or seals on rotating shafts. These lubricants are based on mineral oil or synthetic hydrocarbons. In particular, in roller bearings and plain bearings, the lubricants cause a separating, load-transferring lubricating film to be built up between the parts that slide or roll on one another. It is thus achieved that the metal surfaces do not touch, and thus, also no friction occurs. The lubrication means must therefore satisfy high requirements with respect to:

Cooling of the friction site,

Extreme operating conditions, such as very high and very low speeds,

High temperatures that are caused by high speeds and loads and associated internal or external heating, Very low temperatures in a cold environment, Special user requirements as regards the running features, e.g., low friction, noise attenuation, Extremely long running times without interim relubrication, Biodegradability.

A ready-to-use gear, an operating fluid for such a gear, and a method for its start-up are known from International Patent Application Publication WO 2007/098523 A2. The operating fluid is formed of a mixture of water and an aliphatic hydrocarbon, in which graphite particles are suspended as a solid lubricant. This solid lubricant is in the form of flocculent graphite particles which have a grain size of less than 50 μm. Other components of these lubricating and cooling fluids are dispersing additives, anti-foaming agents, and corrosion inhibitors. In this operating fluid, it is disadvantageous that the graphite particles that are present in solid or flocculent form settle out of the suspension and thus can adhere to the working parts to be lubricated. Another drawback is the persistent fouling of components that come into contact with graphite-containing lubricants. If filtration of the lubricating oil during operation is necessary, the graphite can result in a clogging of the filter pores. In addition, the operating fluid has a very low viscosity, which in the case of high loads, can result in a failure of the lubricating film.

SUMMARY OF THE INVENTION

A primary object of this invention is therefore to prepare a water-based lubricant that meets the above-mentioned requirements, in particular is biodegradable, and contributes to significantly reducing the production of carbon dioxide.

This object is achieved according to the invention in that a lubricant is used that comprised of water, water-soluble polyalkylene glycols, water-soluble emulsifiers, and additives conventionally used in lubricants. The water-soluble polyalkylene glycols are selected from the group of statistically distributed polyoxyethylene units and polyoxypropylene units and/or other polyoxyalkylene components with one or more hydroxyl end groups and from a block polymer that consists of polyoxyethylene units and/or polyoxypropylene units, and/or other polyoxyalkylene components. As emulsifiers, anionic surfactants, e.g., sulfonates, non-ionic surfactants, e.g., fatty alcohol ethoxylates, or NPE or cationic surfactants, e.g., quaternary ammonium compounds, water-soluble or water-emulsifiable carboxylic acid esters are used.

It was found, surprisingly enough, that certain water-based formulations (water content >10%) exceed the lubrication output of conventional lubricants and significantly reduce friction coefficients. Because of this and owing to the good intrinsic cooling action, reduced temperature development occurs in the tribological system. Such water-based lubricants are readily biodegradable and are environmentally compatible in an aquatic environment. In addition, they are distinguished by good compatibility with rubber-elastic materials.

Depending on the application, for example, the low-temperature behavior of water-based lubricants can be considerably improved by, for example, addition of anti-icing additives, e.g., low-molecular glycols, glycerol, salts, or ionic liquids.

In addition, additives can be added to influence the properties of the lubricant in a targeted manner. The latter can be present in soluble, or dispersed, colloidal or nanoscale form.

If desired, water-based lubricants can also be formulated in a foaming manner. The application as spray foam is of special interest in this connection, since as a result, a visual monitoring of the lubricant application is made possible. In the case of a contamination of textiles or machine parts with water-based lubricating fluids, the latter are easy to clean.

To dye lubricants based on mineral oil or synthetic oil, in most cases harmful and/or ecotoxicological dyes are necessary. In the case of water-based lubricants, a number of toxicologically harmless water-soluble dyes up to food coloring can be used. The "base oil" according to the invention can also be transformed by mixing with soap or urea powders, sheet silicates or other current lubricant thickeners to form a lubrication fat or a lubrication paste.

BRIEF DESCRIPTION OF THE DRAWINGS

The sole FIGURE of the drawings is a graph showing torque of a roller bearing with foamed and grease lubricants.

DETAILED DESCRIPTION OF THE INVENTION

A preferred embodiment of the water-based lubricant according to the invention contains:

5 to 80% by weight of water-soluble polyalkylene glycol that is selected from the group that consists of statistically distributed polyoxyethylene units and/or polyoxypropylene units and/or other polyoxyalkylene components, a block polymer that consists of polyoxyethylene units and/or polyoxypropylene units and/or other polyoxyalkylene components, 0.5 to 20% by weight of foaming or non-foaming emulsifiers from the class of anionic surfactants (e.g., sulfonates), non-ionic surfactants (e.g., fatty alcohol ethoxylates or else NPE) or cationic surfactants (e.g., quaternary ammonium compounds), or water-soluble or water-emulsifiable carboxylic acid esters, 0.5 to 50% by weight of anti-icing additives, selected from the group that consists of alkylene glycol, glycerol, salts or ionic liquids, 0.05 to 10% by weight of corrosion additives, such as alkanolamines, boric acid or carboxylic acid derivatives, 0.001 to 1% by weight of additives for preventing the formation of foam, e.g., polydimethylsiloxanes or acrylate polymers, and 0.05 to 5% by weight of wear protection agents Water added to make 100% by weight.

In addition, the lubricant composition can contain the following components:

0.001 to 0.5% by weight of biocides, e.g., sorbic acid and/or 0.05 to 5% by weight of nanoparticles.

In addition, the lubricant composition can contain 0.5 to 40% by weight of lubricant thickener, selected from the group that is comprised of metal soaps that are formed of monocarboxylic acids and/or dicarboxylic acids, ureas, sheet silicates, solid lubricants, and aerosil.

EXAMPLES

Example 1

For the production of a gear oil, the following components are mixed:

| | |
|---|---|
| Distilled water | 45.0% by weight |
| Propylene glycol | 20.0% by weight |
| High-molecular polyethylene glycol | 25.0% by weight |
| Alcohol polyglycol ether | 5.0% by weight |
| Alkanolamine and boric acid derivative | 2.0% by weight |
| Sulfurized fatty acid | 3.0% by weight |

This is a virtually colorless, limpid solution of ISO VG 32 with little foaming tendency. The lubricant remains liquid up to temperatures of −35° C.

The friction level that is drastically reduced in comparison to conventional lubricants results in considerably improved energy efficiency and a lower noise level as well as extended service life during operation. Because of the replacement of mineral oil or a base oil that corresponds thereto by water, the advantage lies in the sustainability of this lubricant.

In particular because of the solid lubricant-free design, such a composite lubricant is suitable for applications in which the lubricant is filtered continuously, such as, e.g., gears in wind power plants.

In Table 1, properties of sample formulation 1 are cited in comparison to a mineral-oil-based product.

TABLE 1

| | Example 1 | Mineral Oil Product |
|---|---|---|
| Viscosity Situation at 40° C. | ISO VG 32 | ISO VG 32 |
| Pour Point | −35° C. | −10° C. |
| Friction Coefficient, SRV Test | 0.058 | 0.100 |
| Hazen Color Unit | 35 | 140 |

Example 2

For the production of a heavy-duty gear oil, the following components are mixed with one another:

| | |
|---|---|
| Distilled water | 38.0% by weight |
| Propylene glycol | 20.0% by weight |
| High-molecular polyethylene glycol | 24.644% by weight |
| Alcohol polyglycol ether | 5.0% by weight |
| Carboxylic acid derivative M-528, Cortec | 10.0% by weight |
| Sulfurized fatty acid | 2.3% by weight |
| Cerium oxide nanoparticles | 0.05% by weight |
| Sorbic acid | 0.003% by weight |
| Acrylic copolymer | 0.003% by weight |

The advantages of the lubricant that are already described in Example 1 are also present here. By the addition of nanoparticles, further improved protection against wear is ensured.

In Table 2, properties of sample formulation 2 are cited in comparison to a mineral-oil-based product. Despite considerably lower viscosity, the aqueous formulation has a significantly improved protection against wear (higher achievable surface pressing) according to Reichert.

TABLE 2

| | Example 1 | Mineral Oil Product |
|---|---|---|
| Viscosity Situation at 40° C. | 110 $mm^2/s$ | 460 $mm^2/s$ |
| Pour Point | −35° C. | −10° C. |
| Surface Pressing According to Reichert | 3,500 $N/cm^2$ | 2,800 $N/cm^2$ |
| Wear Scale According to VKIS [Industrial Lubricants Users Group] Worksheet | | |
| Hazen Color Unit | 130 | 230 |

Example 3

An oil foam consists of:

| | |
|---|---|
| Distilled water | 50.0% by weight |
| Propylene glycol | 15.0% by weight |
| High-molecular polyethylene glycol | 25.0% by weight |
| Foaming fatty alcohol ethoxylate | 5.0% by weight |
| Alkanolamine and boric acid derivative | 2.0% by weight |
| Sulfurized fatty acid | 3.0% by weight |

The advantages of the lubricant that are already described in Example 1 are also present here; the pour point of the formulation is approximately −20° C.

This composition has a high foam formation, which makes possible the application by means of spray/pump spray as a foam.

Such an application has the advantage that the lubricant on the surface can be easily detected visually, even with a minimal amount of lubrication immediately after application, e.g., with the focus on quality assurance. Another advantage of the application as a foam is the improved wetting of the entire surface of the tribological system, which makes possible a shortened intake time and an improved intake behavior.

In the FIGURE, the torque of a roller bearing lubricated with known grease lubricant and a foam lubricant in accordance with the present invention are show. As can be seen, a roller bearing that is provided with foamed (not water-based) lubricant experiences a considerably lower torque within the first 60 minutes of running time than the grease lubricant.

Example 4

Production of a water-based fat with low-temperature suitability containing:

| | |
|---|---|
| Distilled water | 32.0% by weight |
| Propylene glycol | 15.0% by weight |
| High-molecular polyethylene glycol | 15.0% by weight |
| Li-Hydroxystearate | 35.0% by weight |
| Na-Sebacate | 3.0% by weight |

In Table 2, properties of sample formulation 4 are cited.

TABLE 3

| | |
|---|---|
| Worked Penetration DIN ISO 2137 | NLGI 2 |
| Base Oil Viscosity, DIN 51562 | 90 cst |
| Flow Pressure at −30° C., DIN 51805 | <1,400 mbar |

Example 5

Lubricant consisting of:

| | |
|---|---|
| Distilled water | 27.5% by weight |
| High-molecular polyalkylene glycol | 50.0% by weight |
| Alkylene glycol | 10.0% by weight |
| Carboxylic acid derivative M-528, Cortec | 2.0% by weight |
| Water-soluble carboxylic acid ester | 10.0% by weight |
| Acryl copolymer | 0.5% by weight |

This lubricant is suitable for lubrication of seals on rotating shafts and, in contrast to the known lubricating agents that consist of mineral oils or synthetic hydrocarbons, it is readily biodegradable and therefore can be disposed of in an environmentally compatible way. It is distinguished by a low friction, good cooling action, good compatibility with rubber-elastic materials, and it has a low potential of water contamination. Advantageously, in the case of dilution with water, it changes the viscosity only slightly and therefore makes possible the formation of an active lubricating film.

The water-based lubricant according to the invention can be used for lubrication of drive elements in chains, gears, roller bearings and plain bearings or for lubrication of seals on rotating shafts in the form of a foam, spray or emulsion, which is applied by means of spray or pump spray systems with the focus of better surface wetting and better detectability of thin lubricating films.

What is claimed is:

1. Water-based lubricant that contains:

5 to 80% by weight of water-soluble polyalkylene glycol that is selected from a random copolymer that consists of polyoxyethylene, polyoxypropylene, other polyoxyalkylene with one or more hydroxyl end groups, or a mixture thereof, and from a block copolymer that consists of polyoxyethylene, polyoxypropylene, other polyoxyalkylene with one or more hydroxyl end groups, or a mixture thereof;

0.5 to 20% by weight of foaming or non-foaming emulsifiers from the class of anionic, non-ionic, or cationic surfactants, water-soluble or water-emulsifiable carboxylic acid esters;

0.5 to 50% by weight of anti-icing additives, selected from the group consisting of alkylene glycol, glycerol, salts or ionic liquids;

0.05 to 10% by weight of corrosion additives, selected from the group consisting of alkanolamines, boric acid or carboxylic acid derivatives;

0.001 to 1% by weight of additives for preventing the formation of foam, selected from the group consisting of polydimethylsiloxanes or acrylate polymers;

0.05 to 5% by weight of friction-reducing agents;

0.001 to 0.05% by weight of sorbic acid as biocide; and 0.05 to 5% by weight of cerium oxide nanoparticles; and water added to make 100% by weight.

2. Lubricant according to claim 1, further comprising:

0.5 to 40% by weight of lubricant thickener, comprised of metal soaps that are composed of monocarboxylic acids or dicarboxylic acids, or combinations therof, ureas, sheet silicates, solid lubricants, and aerosol.

3. Method of lubricating drive elements, comprising the steps of:

providing a biodegradable lubricant formed of:

5 to 80% by weight of water-soluble polyalkylene glycol that is selected from a random copolymer that consists of polyoxyethylene, polyoxypropylene, other polyoxyalkylene with one or more hydroxyl end groups, or a mixture thereof, and from a block polymer that consists of polyoxyethylene, polyoxypropylene, other polyoxyalkylene with one or more hydroxyl end groups, or a mixture thereof, 0.5 to 20% by weight of foaming or non-foaming emulsifiers from the class of anionic, non-ionic, or cationic surfactants, water-soluble or water-emulsifiable carboxylic acid esters, 0.5 to 50% by weight of anti-icing additives, selected from the group consisting of alkylene glycol, glycerol, salts or ionic liquids, 0.05 to 10% by weight of corrosion additives, selected from the group consisting of alkanolamines, boric acid or carboxylic acid derivatives, 0.001 to 1% by weight of additives for preventing the formation of foam, selected from the group consisting of polydimethylsiloxanes or acrylate polymers, 0.05 to 5% by weight of friction-reducing agents, 0.001 to 0.05% by weight of sorbic acid as biocide, 0.05 to 5% by weight of cerium oxide nanoparticles, and water added to make 100% by weight; and applying the lubricant to the drive elements.

4. Method of lubricating drive elements according to claim 3, wherein said drive elements to which the lubricant is applied are selected from the group consisting of chains, gears, bearings and shafts.

5. Method of lubricating drive elements according to claim 3, wherein the lubricant is applied in the form of a foam, a solution or an emulsion by means of a spray system.

6. Method of lubricating drive elements according to claim 3, wherein the lubricant is sprayed on in the form of a foam.

7. Lubricant according to claim 1, containing 27.5% by weight water.

8. Lubricant according to claim 1, containing 45.0% by weight water.

9. Lubricant according to claim 1, containing 50.0% by weight water.

10. Method of lubricating drive elements according to claim 3, the lubricant further comprising:

0.5 to 40% by weight of lubricant thickener, comprised of metal soaps that are composed of monocarboxylic acids or dicarboxylic acids, or combinations thereof, ureas, sheet silicates, solid lubricants, and aerosol.

* * * * *